United States Patent [19]

Cale

[11] 4,204,419

[45] May 27, 1980

[54] BRAKE-ROD JAW WITH TWISTED FORKS

[75] Inventor: Roland E. Cale, Cortland, Ohio

[73] Assignee: Schaefer Equipment Incorporated, Warren, Ohio

[21] Appl. No.: 971,199

[22] Filed: Dec. 20, 1978

[51] Int. Cl.[2] ..... B21K 1/74

[52] U.S. Cl. ..... 72/356; 72/371; 29/175 A

[58] Field of Search ..... 72/356, 371, 377; 29/7, 29/175 A, 175 R; 59/30, 86

[56] References Cited

U.S. PATENT DOCUMENTS

| | | | |
|---|---|---|---|
| 810,007 | 1/1906 | Ward | 72/371 |
| 1,925,119 | 9/1933 | Summerhays | 72/371 |

*Primary Examiner*—Lowell A. Larson

*Attorney, Agent, or Firm*—Brown, Flick & Peckham

[57] ABSTRACT

Metal stock is forged into a blank consisting of a rod-like shank joined at one end to the inner ends of a pair of substantially parallel forks having enlarged flattened outer ends projecting laterally away from each other in a common plane and provided with pin-receiving openings with parallel axes. The forging operation provides each fork with the appearance of a 90° twist. After the blank is formed the forks are twisted on their axes in directions that will substantially eliminate their twisted appearance and will turn their enlarged ends into spaced parallel planes with their pin-receiving openings in axial alignment.

1 Claim, 9 Drawing Figures

BRAKE-ROD JAW WITH TWISTED FORKS

Brake-rods are used for connecting brake cylinders to the live levers of railway car brake rigging and also for connecting the dead levers to the car bodies. The ends of such rods are provided with clevises or jaws that receive the brake levers. Pivot pins extend through the jaws and levers to form pivotal connections.

The preferred embodiment of the invention is illustrated in the accompanying drawings, in which FIG. 1 is a plan view of a forged blank;

It is among the objects of this invention to provide a simple method of making brake-rod jaws, in which one step is a forging operation that does not require deep die cavities, and a following step is a twisting operation.

Figure 1:
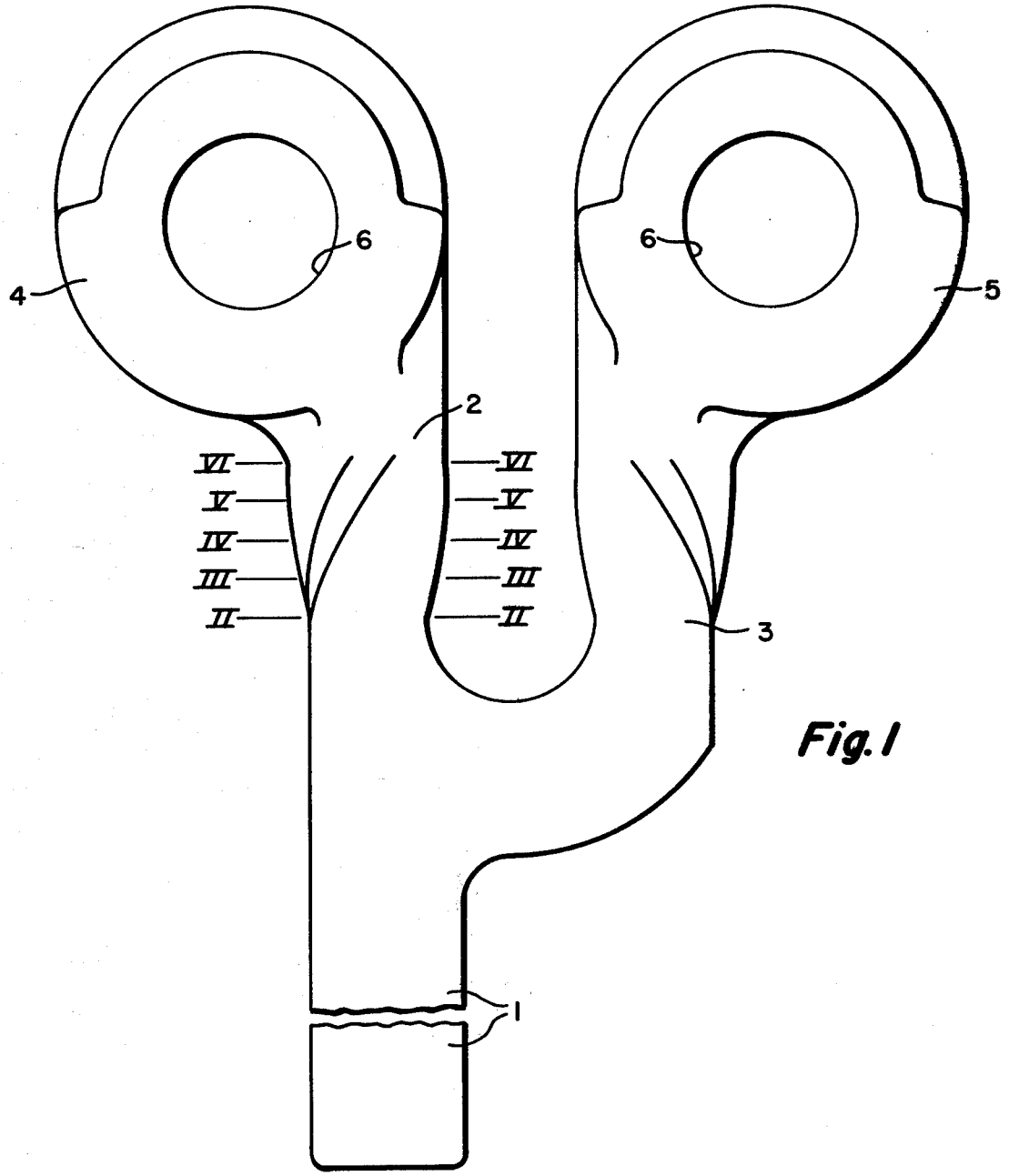
Figure 2:
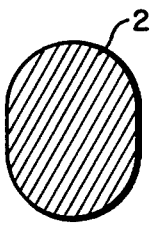
FIGS. 2 to 6 are cross sections of one of the jaw forks, taken on the lines II—II, III—III, IV—IV, V—V and VI—VI, respectively, of FIG. 1, it being understood that sections through the other fork corresponding to III—III, IV—IV and V—V would be tilted in a direction opposite to those shown in FIGS. 3, 4 and 5.
Figure 3:
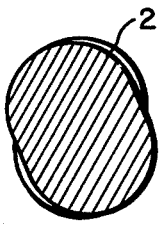
Figure 4:
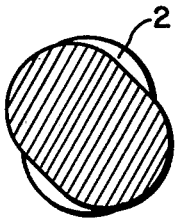
Figure 5:
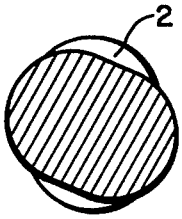
Figure 6:
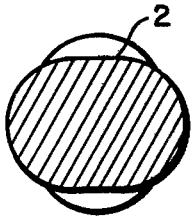
Figure 8:
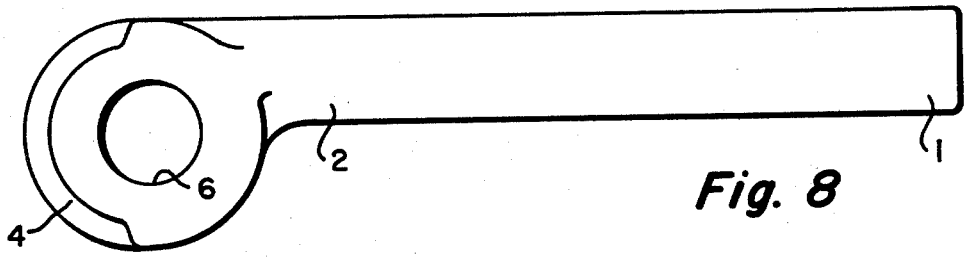
FIG. 8 is a side view of the finished jaw.

Referring to FIG. 1 of the drawings, metal stock, such as a bar, is forged between forging dies to form a more or less flat blank. The dies are provided with shallow cavities of such shape that the blank will consist of a straight rod-like shank 1 that is integrally joined at one end to the inner ends of a pair of substantially parallel forks 2 and 3. The forks have enlarged flattened outer ends 4 and 5 projecting laterally away from each other, with the two enlarged ends lying in a common plane, in which the forks and shank also lie. The ends of the forks are enlarged for the purpose of accommodating pin-receiving openings 6 that are formed during the forging operation. The axis of the forks may be located symmetrically relative to the shank, but it is preferred that one of the forks be aligned, or substantially aligned, with the shank, with the other fork extending laterally away from the shank a short distance and then outwardly beside the first fork. In either case, in accordance with this invention, the forging dies are so shaped that they provide the forks with the appearance of a 90° twist. That is, each fork looks as if it had been twisted on its axis 90°, the apparent twist of each fork being in a direction opposite to the twist of the other fork. It will be seen that the forging of this blank requires only relatively shallow forging die cavities.

Figure 9:
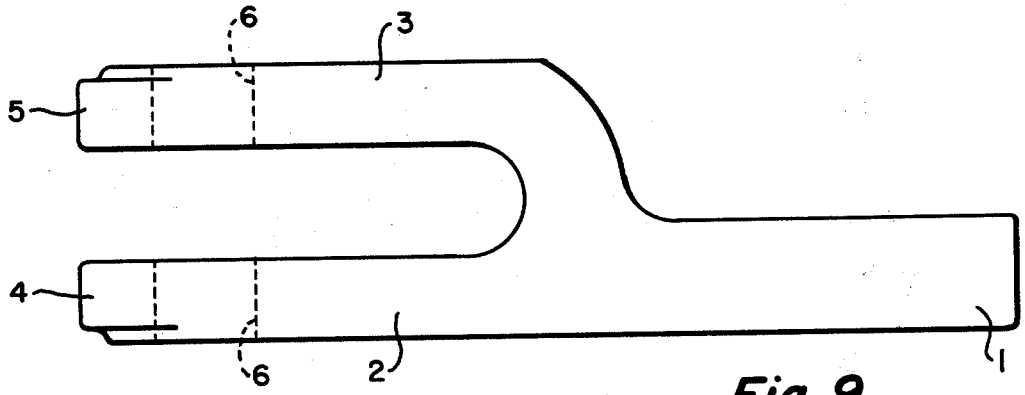
FIG. 9 is a plan view.
Figure 7:
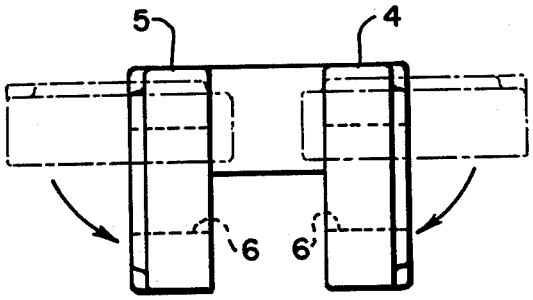
FIG. 7 is a reduced view of the open end of the jaw after twisting of the forks.

The next step in the method is to twist the forks 90° on their axes in opposite directions, by which is meant that one is twisted clockwise and one is twisted counterclockwise. As indicated in FIG. 7, the direction of the twist is such that it will substantially eliminate the twisted appearance of the forks. In other words, they will appear to be untwisted from their original forged condition. The 90° twist also turns the enlarged outer ends 4 and 5 of the forks at right angles to their original position in the forged blank, so that they become located in spaced parallel planes with their pin-receiving openings 6 in axial alignment as shown in FIGS. 7 and 9. Following this twisting of the forks it usually is advisable to ream the pin-receiving openings in order to smooth their walls and to make sure that a pivot pin can be inserted.

Since it is desirable that the forks of the finished jaw have flat parallel sides, the forging dies are so formed that they will provide the forks with a cross section that gives them parallel straight flat sides after the 90° twisting operation. Several cross sections of a fork before twisting are shown in FIGS. 2 to 6.

After the coaxial pin-receiving openings have been reamed, the jaw is ready for the outer end of its shank to be butt welded to one end of a brake-rod.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. The method of making a railway car brake-rod jaw having a pair of parallel forks with substantially flat sides all substantially parallel to one another, comprising forging metal stock into a blank consisting of a rod-like shank joined at one end to the inner ends of a pair of substantially parallel forks having enlarged flattened outer ends disposed in a common plane and provided with pin-receiving openings therethrough having substantially parallel axes, the forging operation providing each fork with a pair of opposite sides that are substantially flat transversely with their inner ends adjacent said shank disposed in planes substantially perpendicular to said common plane and having their remaining areas extending from their inner ends helically 90° around the fork toward said flattened outer end to provide the fork with the appearance of a 90° twist, and then twisting the forks 90° on their axes in directions that will substantially eliminate said twisted appearance and will turn said enlarged ends into spaced parallel planes with their pin-receiving openings in axial alignment and with all of said flat sides straight and substantially parallel to one another.

* * * * *